US007392737B2

(12) United States Patent
Mayorca

(10) Patent No.: US 7,392,737 B2
(45) Date of Patent: Jul. 1, 2008

(54) DYNAMIC SYSTEM FOR REFRIGERATION EQUIPMENT

(76) Inventor: Aurélio Mayorca, Rua Nacar N° 635/435, Joinville Santa Catarina (BR)

( * ) Notice: Subject to any disclaimer, the term of this patent is extended or adjusted under 35 U.S.C. 154(b) by 0 days.

(21) Appl. No.: 10/552,749

(22) PCT Filed: Apr. 6, 2004

(86) PCT No.: PCT/BR2004/000050

§ 371 (c)(1),
(2), (4) Date: Jul. 19, 2006

(87) PCT Pub. No.: WO2004/090338

PCT Pub. Date: Oct. 21, 2004

(65) Prior Publication Data

US 2007/0022759 A1 Feb. 1, 2007

(30) Foreign Application Priority Data

Apr. 10, 2003 (BR) ..... 0301654
Feb. 27, 2004 (BR) ..... C20301654

(51) Int. Cl.
*F02B 75/28* (2006.01)
*F01B 7/00* (2006.01)

(52) U.S. Cl. ..... 92/69 B; 417/341

(58) Field of Classification Search ..... 60/545, 60/910; 74/25, 44, 45, 51; 92/31, 69 B, 92/76, 139; 417/341
See application file for complete search history.

(56) References Cited

U.S. PATENT DOCUMENTS

| | | | | |
|---|---|---|---|---|
| 753,787 | A * | 3/1904 | Dean | 417/341 |
| 2,078,157 | A * | 4/1937 | Pescara | 417/341 |
| 2,203,648 | A * | 6/1940 | Dons | 123/51 BB |
| 3,130,592 | A * | 4/1964 | Burrison | 92/69 R |
| 3,791,770 | A * | 2/1974 | Farkos | 417/418 |
| 5,649,809 | A * | 7/1997 | Stapelfeldt | 417/63 |
| 6,318,309 | B1 * | 11/2001 | Burrahm et al. | 123/51 A |
| 6,336,883 | B1 * | 1/2002 | Bevc et al. | 474/166 |

* cited by examiner

*Primary Examiner*—Thomas E. Lazo
(74) *Attorney, Agent, or Firm*—TraskBritt, P.C.

(57) ABSTRACT

This is a dynamic system for refrigeration equipment. This invention provides special features, including a set of mechanisms, electro-mechanisms, and electronic controls for refrigeration compression chambers or other kinds of fluids that employ two, three, or four compression chambers. There is extremely low vibration, noise, cost, and energy consumption in this equipment. It does not overheat and has a reduced size, lightweight and requires less raw materials to build it. There are other advantages in its technical aspects. It can be run on an electric motor or only with solenoid coils for traction. The applications include, but are not limited to, refrigerators, freezers, air conditioners, cold stores, refrigerated trucks, compressors for automotive air-conditioning, etc. Other applications include those that normally require a piston (piston-air compressor or diaphragm compressor to fill tires, spray painting, etc . ). The invention also provides a new type of internal combustion engine for automobiles and trucks, etc.

16 Claims, 9 Drawing Sheets

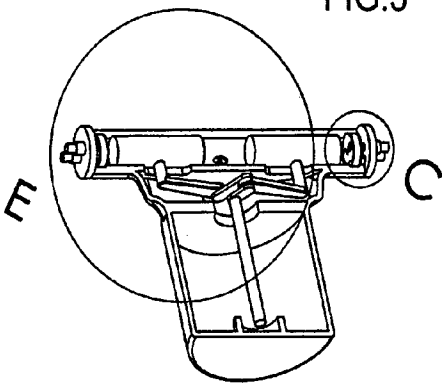
FIG.3
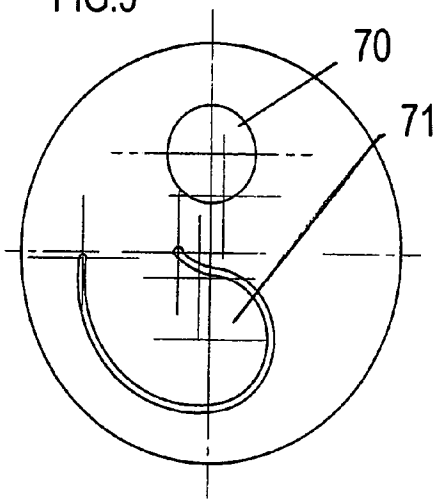
FIG.5
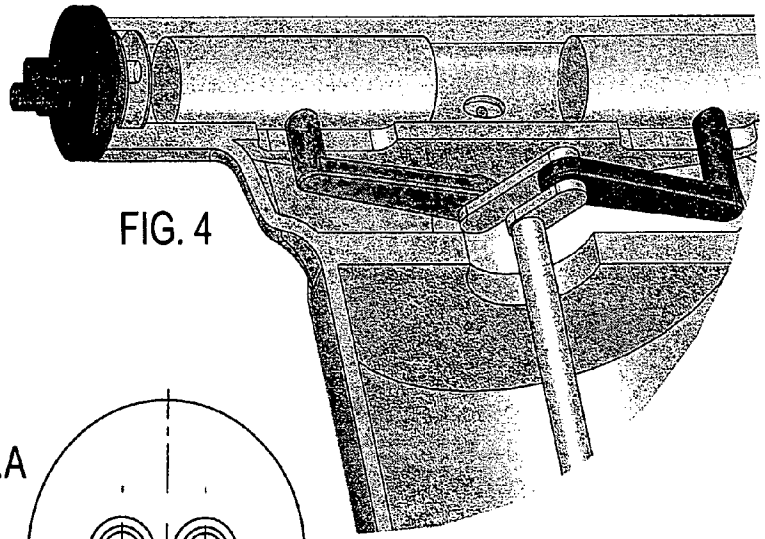
FIG. 4
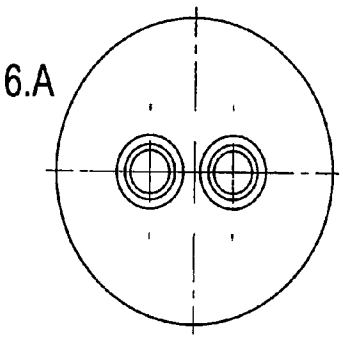
FIG. 6
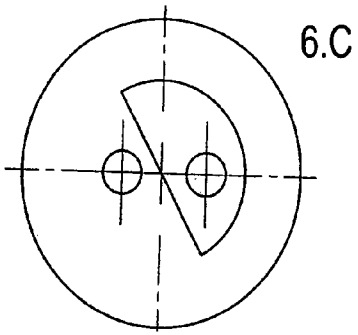
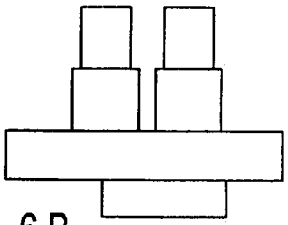

FIG.8
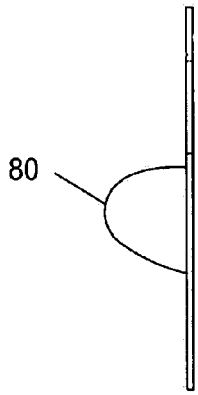
FIG.7
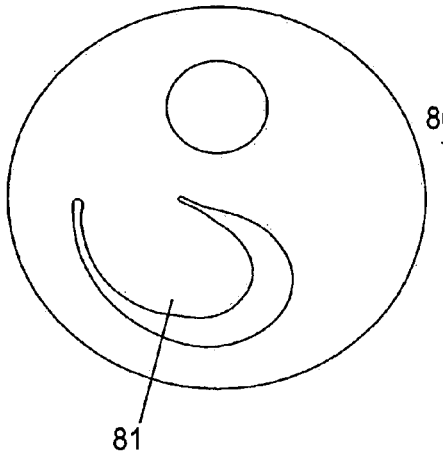
FIG.9
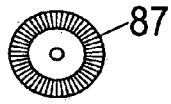
FIG.10
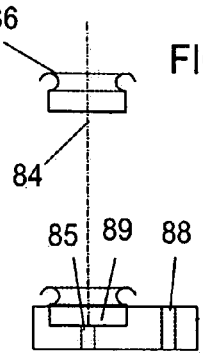
FIG.11
FIG.12
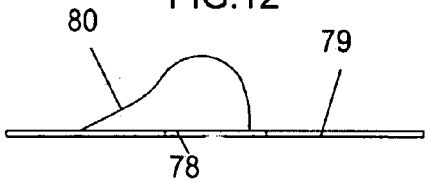
FIG.13
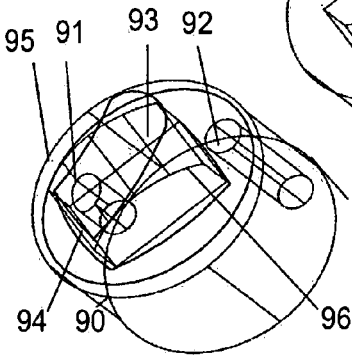
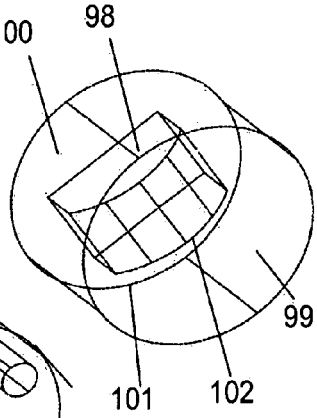
FIG.14

FIG.15
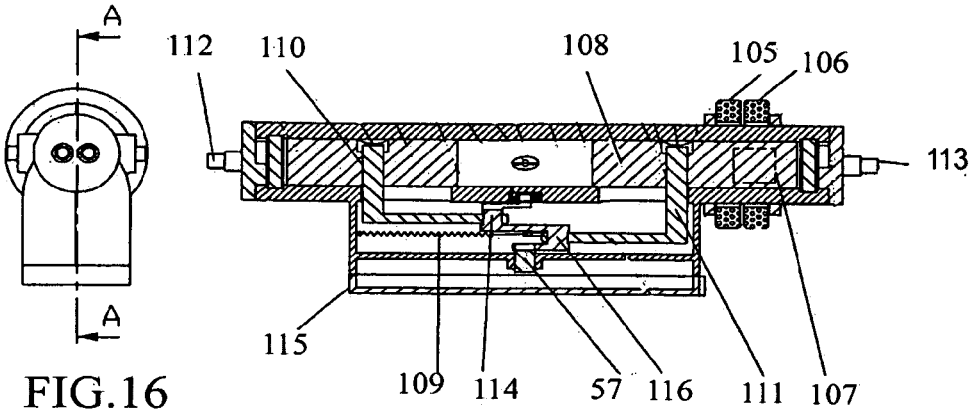
FIG.16
FIG.17
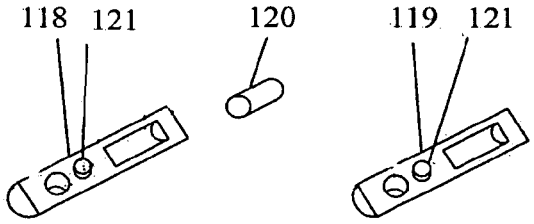
FIG.18
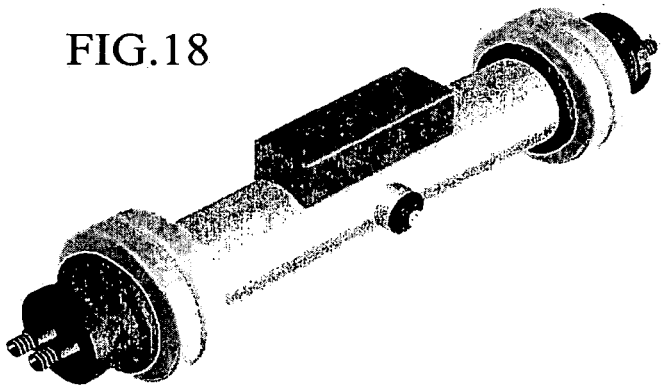
FIG.19
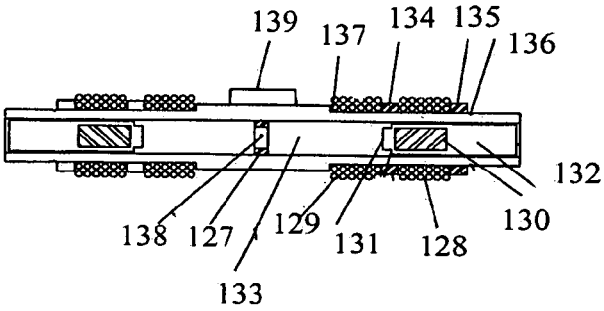

DYNAMIC SYSTEM FOR REFRIGERATION EQUIPMENT

This application is a National Entry of PCT International Patent Application No. PCT/BR2004/000050 filed on 6 Apr. 2004, designating the United States of America, and published, in English, as PCT International Publication No. WO 2004/090338 A2 on 21 Oct. 2004, which itself claims the benefit of Brazilian Application Serial No. C20301654-4 file 27 Feb. 2004 and Brazilian application Serial No. P10301654-4 filed 10 Apr. 2003.

TECHNICAL FIELD

This text refers to the following invention, which is an electric-electronic mechanic mechanism component setup, which allows for the best fluid compressor performance (gas, air, oil, water, or other types of fluids), there are so many advantages compared to the current technology for compressors.

The current refrigeration technology applies to diverse processes, such as: compressing and expanding refrigeration gas, nitrogen cylinder, Peltier cells, etc . This invention, which this patent is for, makes it possible to make great progress in the first process (which is, compressing and expanding fluids).

BACKGROUND

Refrigeration technology through compression and expansion of refrigeration gas and compression of fluid by means of piston movement within the cylinder that uses an electrical motor propulsion force is relatively old-fashioned. Moreover recently, propulsion force without the use of an electric motor; as the motor has been substituted by a solenoid coil that propels the piston forming a fluid compression chamber at "one" of its extremities.

DISCLOSURE OF THE INVENTION

One of the innovative properties of our new technology is: there has been created not just "one" but "two" compression chambers, this is "one at each piston extremity" (taking advantage of both piston" extremities, see diagram FIG. 15, FIG. 18, and FIG. 19).

Our great invention that uses "two" symmetric pistons, forming as such, "three compression chambers," as one of these chambers has "double the volume" of the other two. Being that, the movement of the "two symmetric pistons" and the "harmonics"; in this manner, it is possible to "annul" the unwanted equipment set vibration.

The main advantages that this new technology offers are the following: the purpose of this patent request, the distinguishing characteristics are the following:

This compressor is much smaller, lighter, more efficient, lower electrical consumption, compresses the fluid more quickly, less vibration and noise, manufactured more quickly and in smaller quantities of raw materials. It runs on a smaller quantity of lubricating oil; therefore, it has a lower environmental impact.

BRIEF DESCRIPTION OF THE DRAWINGS

FIG. 3 is a sectional view of a compressor;

FIG. 4 is a partial sectional view of the compressor of FIG. 1;

FIG. 5 is a front elevational view of a unidirectional valve;

FIG. 6*a*, 6*b* and 6*c* are a top, side and bottom view of a cover;

FIG. 7 is a front view of an alternative valve;

FIG. 8 is an elevational side view of the valve of FIG. 7;

FIG. 9 is a top view of a ring absorber;

FIG. 10 is a side view of a ring absorber;

FIG. 11 is a cross sectional view of a spacer valve base;

FIG. 12 is a side view of a valve;

FIG. 13 is a perspective view of another embodiment of a valve;

FIG. 14 is a perspective view of a piston extremity;

FIG. 15 is a cross sectional view of a compressor set without a motor;

FIG. 16 is a front view of a compressor of FIG. 15;

FIG. 17 is a perspective view of a disassembled ferromagnetic core;

FIG. 18 is a perspective view of a compressor;

FIG. 19 is a partial cross sectional view of a compressor;

DETAILED DESCRIPTION OF THE INVENTION

On the attached diagrams, which are an integral part of the report, on page 1/9 it shows a perspective view of the product. Then to be more specific, it shows the possibilities of the product; for example, the horizontal cylinder in the upper part, can be multiplied by two, four, etc . perpendicularly). The outer product casing, as it is made up by joining the two symmetric shells, which can be fastened by welding or screws, being that the operating mechanism components are located on this side. These "shells" can be built out of the following raw materials: injected aluminum, reinforced plastic, resinous fiber, cast steel, or steel press-molded, ceramic, etc .

Figure 1:
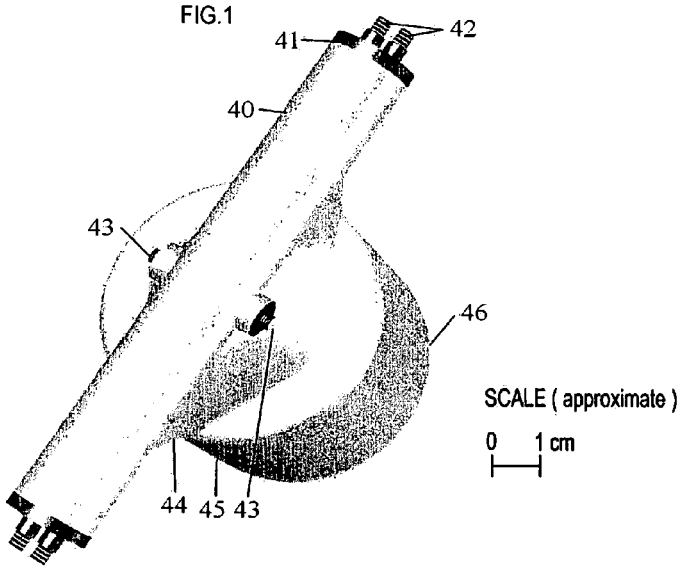
FIG. 1 is a perspective view of a compressor of the invention.

Pointing out more details on page 1/9, FIG. 1 number 40 is a hollow horizontal cylinder, 41 is the cylinder cover (this cover may be screwed down or welded to the cylinder), 42 displays two holes for the fluid to enter and exit, at the other extremity (on the opposite side) there is the identical set of holes.

Number 43 points out the fluid inflow and outflow, the same as the opposite holes (hence, these holes are symmetrical "at the center," which can be substituted by a pair of holes on only one side, similar to the pair of extremity holes). Either format is acceptable.

Number 44 displays a coupling (or "neck"), which is: the horizontal cylinder connection (or for the horizontal cylinders) the motor (traction source). Although, the traction source does not need a motor (this is optional), traction can be obtained through solenoids, installed surrounding the horizontal cylinder (according to diagram pages 4/9 and the diagrams in FIGS. 15, 16, 17 and 18).

Continuing on Page 1/9, FIG. 1, Number 45 displays the electric motor (in fact, the motor is within the same casing as the compressor, but the motor housing is the same enclosed compressor casing).

Number 46 is the back or the lowest part. The compressor attachment to a machine structure (for instance, a refrigerator, etc . ) can be placed at the lower part of the appliance. Hence, this unveils challenging possibilities for the project designers (to foster their creativity).

On the diagram on page 1/9, it displays a rear diagram view of the last diagram. Whereas FIG. 2 shows a cutaway view of the last diagram, where 50 displays the horizontal cylinder wall, 51 are the horizontal cylinder covers (there are two symmetric covers, referring to Diagram of FIG. 6 on diagram page 2/9, where "6A" is a front view, 6C is a top view, 6B is also a side view, but from the viewpoint of within the cylinder).

Figure 2:
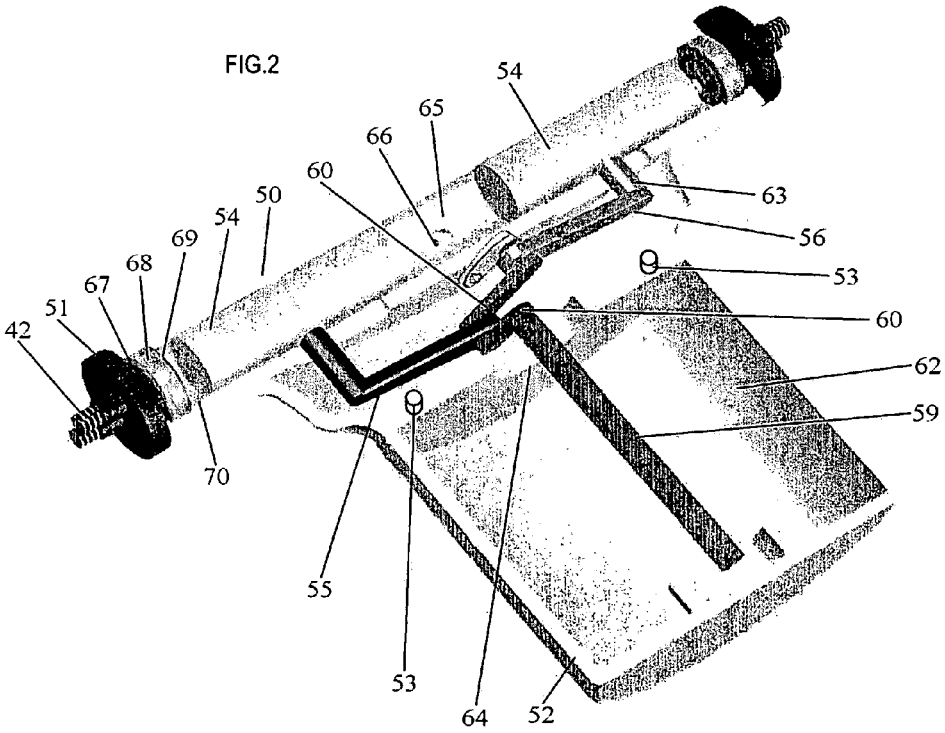
FIG. 2 is a cross sectional perspective view of the compressor of FIG. 1.

While still looking at diagram page 1/9, FIG. 2, number 52 displays the external casing wall, 53 displays the fittings (the "male-female" pins) when the "two shells" are fitted, the whole component unit is centralized, so these pins act as "guides" that lead to the "shell" stability, for welding or screwing purposes.

Continuing on page 1/9, FIG. 2 number 54 displays the pistons, which locate within cylinder 1, the articulating connecting rods 55 transfers traction to the cylinder 54. The movement is linear and these connecting rods 55 and 56 are connected to the double crankshaft 60, axles 59 are the motor axles, that just surround these axles with the rotor (that just surround these rotor axles) (this fitting is under pressure). Inside "shell" 62, there is the motor stator that just fits perfectly, rubber, polyurethane, plastic, or other materials for the shims.

Number 63 displays the opposite articulating rod, the same as 55 and 56 (they are symmetric).

Number 64 is a divider that can optionally hold a retainer to protect against oil lubrication infiltration and then to keep the articulating connecting rods immersed in oil. Therefore, it is possible to choose if the oil-lubricant insulation penetrates the inner parts of the motor, so as to lubricate, cool, protect, and to increase its useful life.

Number 70 displays one of the compressor chambers, the same as the other extremity. Number 65 displays the other compressor chamber (so it is possible to consider this as a "central double chamber").

Number 66 displays the hole for the lateral fluid inflow and outflow.

Number 67 displays one of the two valves that control the fluid inflow and outflow (this valve is made from flat pressed sheet metal (this is shown on page 3/9, see FIGS. 7 -14).

Continuing on page 1/9, Number 68 is a "spacer" made of steel, polyurethane, ceramic, or other materials, which is a "cylindrical spacer pad" for the two valves, this spacer has two through holes for fluid flow (each through hole allows for a unidirectional flow). Number 69 is the other valve that serves the same purpose (symmetrical) so this is an identical valve-spacer as in the opposite extremity.

On diagram page 2/9, FIG. 4 displays a "partial cutaway" view, this is pictured on page 1/9, FIG. 2, whereas in FIG. 3, E and C display the cylinder extremities.

Another detail on page 2/9 FIG. 5 displays the valve with a hole and a slit; this last mentioned detail forms a fin (or latch). FIG. 6 displays three cover views.

On pages 2/9, FIG. 5 displays a front view of the unidirectional valve, whereas 70 is a hole for unrestricted fluid flow and 71 shows a metallic plate (or strip), which curves by means of the fluid pressure.

Another detail on page is 3/9, FIGS. 7-14 this displays another valve model, which can be called "CURVED VALVE," which is previously curved (or slightly flared), this curve is shown as FIG. 12, side view (see 78-80). This curve on the plate is for reducing the noise that comes from the "intermittent knocking" from the plate onto the base (opening and closing the fluid flow intermittently), this noise is similar to a buzzer. The main principal is similar to any flat plate that may be made of (metal, paper, cardboard, etc . ), that if it is knocked against any surface it makes noise (from knocking on the surface of a table), however if it is curved, then it meets the surface silently (therefore, the "mechanical" noise is eliminated, so you can say that the plate does not go straight down, but instead it "unrolls").

FIG. 10 shows a "ring absorber," made out of thin sheet that is fit into the spacer (valve base) around hole 84, to be more exact at hole 85 (see FIG. 11, that shows a cutaway view of the "spacer," which is the base for the valve). So, when the valve goes down, it first touches this ring on part 86, this absorbs the fall impact, thus reducing the noise. "VIEW 9" shows a top view of the ring absorber, whereas 87 is the fluid flow hole.

Another detail on diagrams is 3/9, FIG. 11, this shows a cutaway view of the spacer (valve base), whereas 85 displays the hole (to be more exact only a slot) for fitting in the absorber ring (see FIG. 10, 85 is the controlling fluid flow hole, 88 shows another fluid flow hole and this one is for controlling the fluid flow commanded by the other valve (symmetric, the same spacer), and 89 display the optional surface base curve depression.

Another drawing on page 3/9 is FIG. 13, this shows another silent valve model, where the plate is "flat" (or "straight"), but the base is curved (or convex, or it could even be the opposite of a "depression," which is "concave," according to the designer's choice). 96 displays the "spacer" (or the valve body base) and 91 and 92 are the fluid flow holes. 93 displays the "flat plate" (called the "valve fin"), 94 is the fin base, 95 is its body, or attachment extension. 96 display the convex base, hole 91 also including convex brackets for fitting the plate, as the fluid pressure will bend the plate, therefore radius 93 must fit the bent curvature, this curvature depends on the plate thickness, the kind of material, its resistance, hardness, etc .

Another detail on diagram page 3/9 if FIG. 14 that shows the piston extremity, there is a depression (or cavity) in the same shape as the valve, this is for reducing the "accumulated fluid" leakage (this is: The small amount of fluid that remains in the compression chamber, and this could not be expelled, just the amount is reduced). 98 shows the cavity that has already been mentioned, 99 is the piston body, 100 and 101 is its extremity. 102 shows the part of the cavity that cannot be displayed on this diagram, as this diagram is drawn in a perspective manner.

On diagram page 4/9, FIG. 15 displays the compressor set without any motor. This project mode is based on the motor-less traction as the traction in this case comes from the solenoid coils. Shown as numbers 105 and 106 are solenoid coils, which means that the ferromagnetic core 107, spacer 108 is moved by a magnetic force generated from the solenoid coils. Therefore the two coils (which are placed at opposite ends at a total of four solenoid coils, see FIG. 18 and FIG. 19 on this page 4/9) advance and retract the piston intermittently (or three coils options). Although, optionally, there may be only one coil, then the piston will retract moved by the spring movement, 109 is a spring that pulls the pistons back to their normal position. Numbers 115 and 116 display the spring stay. Number 57 is a double crankshaft. This diagram shows the string attached to the left rod (number 110), but it may be attached to the articulating connecting rod number 111 (this is what keeps the pistons usually retracted). FIG. 16 displays a front view of the motor-less compressor (the same as the above mentioned, at FIG. 15). See FIG. 19, whereas number 139 is an electrical connector so that it may house the electronic circuit (for controlling the solenoids). In FIG. 15, numbers 112 and 113 are the outflow and inflow fluid holes. Around axle 117, you can install an optional "Inertial disk" (whose angular momentum can be calculated by multiplying mass x velocity, this supplies rotational motion to axle 57). Further on this page is FIG. 17, which displays a piston model (preferentially made of Teflon or nylon). These two part numbers 118 and 119 fit symmetrically, being that number 120 is the ferromagnetic core that fits inside these parts, numbers 121 and 122, are fitted (male and female) to facilitate machining. Numbers 123 and 124 are the holes to fit the articulating connected rods. The left piston would be the same diagram; only it would be smaller (as there is no ferromagnetic core, or optionally as it could have one to make it more reinforced and stable under high pressures).

On diagram page 4/9, FIGS. 18 and 19, there are displayed a more detailed derivative technology model, where just the double crankshaft and the connecting rods (articulating) are done away with and therefore a safety ring is added (this is a soft material such as rubber, nylon, ambatex, or any other similar material), shown as number 127 (FIG. 19), the purpose is to reduce any collision impact between the two pistons. Two equal polarity magnetic extremities may be placed at both ends (repellant, known as "permanent magnet" or "electro magnets") on the piston tips (this is also for reducing the impact). Or there may be a spring placed between the two pistons (for avoiding collision impact and favor harmonic oscillatory movement). Numbers 128 and 129 display electromagnetic coils (there may also be only one coil, for each piston, the designer may choose this option using the above-mentioned spring between the two pistons), which are activated from the magnetic core 130, piston 131, moving linearly (back and forth). Numbers 132 and 133 display the fluid compressor chambers. Numbers 134 and 135 are non-magnetic rings (and preferably, they are electrical non-conductors), for spacing between the coils.

Another detail on diagram page 4/9, FIG. 19, number 136 displays a ring fitting for attaching coils 128 and 129. Number 137 displays a protuberance on the cylinder wall. The main purposes are: mechanical support for the coils; and reinforcing the cylinder wall against internal mechanical pressure produced by the pressurized fluid.

Number 138 shows the hole for the fluid entrance and exit.

Number 139 shows a compartment for housing an electronic component set for controlling the coils, as well as, controlling the position sensors (that show the position of each piston), while the equipment is operating (going back and forth) these may be an inductive sensor, capacitive sensor, or others, etc.

This model runs the same as those that are based on the double crankshaft and connecting rods. Although, there is a need for a dependable electronic controller (this needs to be well-adjusted), and that slides almost frictionless, keeping the oscillating movement, perfectly symmetric, and unsynchronized (out of phase) to eliminate all vibration.

Figure 20:
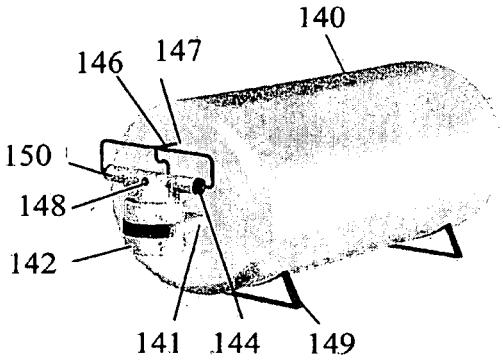
FIG. 20 is a perspective view of a compressor system.

On diagram page 5/9, it displays the air compressor system, where FIG. 20, number 140 is a tank.

This is a patent request and it is also for showing the possible applications for this new technology according to the original request. The last diagrams displayed are for refrigeration or other usages), and, besides compressing fluids for refrigeration as it is lighter, smaller quantities of raw materials, takes less space, increased stability and much smaller consumed energy costs, lower manufacturing cost, greater profitability, etc.) and a combustion motor (similar to those used in automobiles and trucks). This also makes it possible to produce a new type of AIR COMPRESSOR. This product is displayed on diagram page 5/9.

The air compressor based on this new technology is the object of this patent request, presents many advantages regarding the present compressor technology. The compressors used nowadays are:

a) It uses flexible diaphragm, connected to a rotational axle by means of a simple crankshaft.

b) It also employs a compression piston (the same as an internal combustion engine made up of a piston, around that there are metallic piston rings for sealing and lubrication), that dislocate within a cylinder compression chamber at either end of its extremities, the same as internal combustion engines (or combustion chamber as in automobiles and trucks).

Among the main advantages for the new air compressor are:

Decreased energy consumption (half or even more economical).

Faster air compression is performed (or compressed air), about two times greater than the speed from the old system (this means that the present-day compressor technology does not take advantage of doubling the consumed power, which now; by using our technology, it is possible to double the speed in producing the compressed air).

—It fills the tank, or compressed air storage much faster.

Decreased vibration and noise (since the vibration is eliminated; or in other words it is compensated by being unsynchronized—out of phase).

Smaller size and uses less raw material to manufacture the product.

Lightweight.

—The equipment does not overheat as much.

—Uses less lubricating oil.

—There is no external motor, pulleys and drive belts, or pulley belt covers, etc .

—More user-friendly to the environment, etc .

—It makes it possible, optionally, to do away with the "lubrication sealing rings" (this depends on your project, or the needed pressure), as these may cause serious friction (generating: over-heating, energy loss, and performance, that in due process causes breakage, destruction, etc . ). Doing away with the "rings" is possible due to our piston design, cylinder shaped held at the extremities; however, the work is performed linearly but without undergoing any torsion.

Take a look at the attached diagrams to see further details of our project.

On page 5/9 FIG. 20 it shows a perspective view of our final product, in which number 140 is the reserve tank made of steel or another material, number 141 is the base that attaches to the rubber bases and the compressor (the main objective in our patent request) which is number 142. Likewise there are numbers 144, 145 and 147 showing the piping, terminals and pipe connections for the inflow or outflow of the pressurized fluid. Number 148 displays the lateral inlet/outlet for the fluid (the same as number 144), however number 148 does not show any connected piping, just for better visibility (to not overload the diagram).

Naturally, there may be some changes in the diagram, or mere technical improvements. Number 149 shows the bases (one pair), or the support bases, for complete machinery stability. It is also possible to build a self-contained unit, which is portable and may be used for non-professional applications (such as for hobbies and do-it-yourself jobs).

The diagram shown on page 5/9, displays the dimensions (scale), the tank (compressed air storage tank) from FIG. 20, these are the dimensions: Diameter=30 cm., length=54 cm, the length of the horizontal cylinder (tube) for the compressor (attached to the left extremity of the tank)=17 cm., the compressor motor diameter is=11 cm. However there can be other sizes you may wish to design and build.

Figure 21:
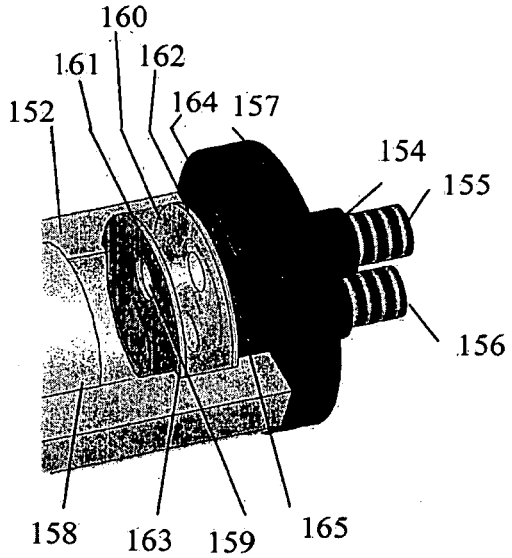
FIG. 21 is a partial perspective view of an end of a compressor.

Another detail on diagram 5/9, is FIG. 21, that shows the drawing partially cutaway at one of its ends that is similar to the opposite side of the hollow cylinder). Number 152 displays the wall (to see the outside on FIG. 20, number 150). Continuing on page 5/9, FIG. 21, numbers 154, 155, and 156 are the fluid inflow and outflow (regarding compressed air), 157 is the external cover wall (this is what covers the extremities, according to what was shown on the last page, there are two extremities, however there can be four, or more, depending on the number of "cylinders 150 (see FIG. 20)" (that may be named as "pipes 1," or the "sleeve 1") that if necessary is placed perpendicularly). Number 158, displays the piston that moves inside "cylinder 1." Number 159 displays a hole in valve "a" (this is shown as 161) for fluid flow, then number 166 shows a "fin" (made out of a round slit, on the same page where the valve is) the purpose of this is to control the fluid flow (blocking it in one direction and freeing it in the other).

Number 160 displays a "separator spacer pad" that holds the two valves (Valves and, or "a" and "b"), this spacer can be made of steel, ambatex, Nylon, polyurethane, ceramic, or other materials, however the more porous or soft the material is the lower the noise level will be).

Number 163 displays a "slit" or fitting on the inside of cylinder 152, for fitting in "valve 161"+"spacer"+valve 162," so in this way, there are two "slits 163," one on each extremity of cylinder 152.

Number 164 shows one of the holes on cover 157, for fluid flow. Number 165 displays a salience on the cover to block one of the fluid outlets. In this way, the fluid is sucked in by piston 158, it enters through hole number 156, it goes through the inside of the salience number 155 (that is a half-moon shape and it is an extension of cover number 157), thereafter it goes through the inside of "spacer" number 160, then on to fin number 166 that opens up (valve number 161), this fills the inside of the cylinder to form the compression chamber. After the fluid has been pressurized, it goes out through hole number 159, then it goes through the inside of "spacer number 160," then through hole number 164, going out through outlet 155, and into its appropriate piping connection. Notice that valve number 162 using the fin for the fluid outflow (the same as valve number 161). Side outlet (symmetric, described above, see page 1/9, FIG. 1, and number 43, and FIG. 2, and number 66), there is also a set of valves the same as numbers 161 and 162 (if you wish to have only one lateral valve, non-symmetrical, for inflow and outflow of fluid then there are numbers 160, 161, 162, and 165).

It is extremely important to notice that this is a completely new technological component setup, the purpose of this invention patent, especially the double crankshaft, which brings out many new possibilities to improve air compressors that applies "contraction and expansion on a flexible diaphragm" (this is generally made of rubber, or a similar material). This type of air compressor is known as a DIAPHRAGM COMPRESSOR.

Figure 22:
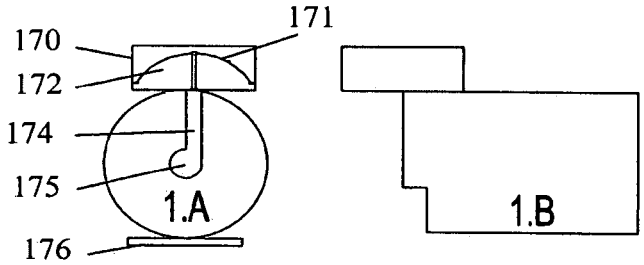
FIG. 22 is a front and side view of a view of a diaphragm compressor.

On diagram page 5/9, FIG. 22 displays a front view (1A) and a side view (1B) of a diaphragm compressor for the present technology, where number 170 shows the cylinder where the diaphragm is located, 171 and the diaphragm, 172 this is on the inside of the diaphragm (that is the air compression chamber), 174 is the channel where the shaft, or the rod that is connected to axle 175, the motor, 176 and a base (or footing).

Figure 23:
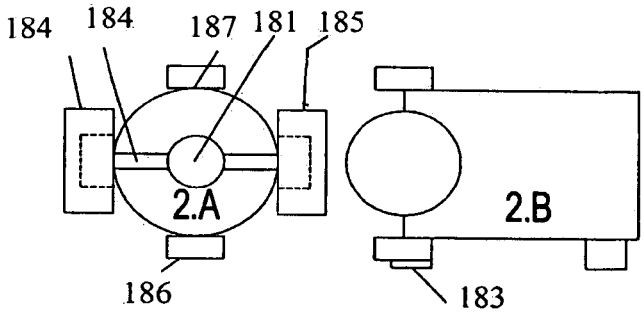
FIG. 23 is front and side view of another diaphragm compressor.

In FIG. 23 shows "our new diaphragm compressor" that uses the double crankshaft (one of the main innovations and our patent claim) in this present patent). It can be built using two diaphragms (inverted, this is, while one is sucking in the fluid, simultaneously, the opposite side is compressing, which is one of the targets of this present patent). This way the vibration will just be reduced (increasing the frequency and decreasing the amplitude and the wave length), however, by using four diaphragms, the unwanted vibration from running this component set is then annulled (this is out of phase or in other words unsynchronized).

FIG. 23 (page 5/9), this diagram shows our new four-diaphragm compressor (shows 2.A is a front view, and 2.B is a side view), where number 184 and 185, 186 and 187 are diaphragm pairs (a total of four units), interconnected by means of four connected rods 180 (symmetric to the double-crankshafts displayed by 181). Note that at this point the diaphragms are smaller (¼ of the size, or a fourth of the diaphragm drainage size in the present day technology, in this case the motor will be smaller, half the size). The base (the footing) is displayed as 183 (in this case the fluid entrance does not take place from the bottom, but it is sealed against sucking the floor dust). However, in this model the connecting rods can be done away with (but if necessary the designer can apply this as a construction option).

For our diaphragm-compressor, the main advantages as when compared to the present technology, are very similar to the advantages described in the beginning of this report shown on FIG. 23, that displays a model with four diaphragms. However there may be two, four, eight or more.

In FIG. 23, shows "our new diaphragm compressor" that uses the double crankshaft (one of the main innovations in this present patent). Where numbers 184 and 185 are a pair of diaphragms, interconnected by means of the straight connecting rods 180 (symmetrical), number 181 shows the double crankshaft. The base (the footing) is number 183.

The advantages are: Better performance (double), greater speed (double), lower vibration noise (as the two diaphragms are the noise is reduced while in the four diaphragm model the noise is completely eliminated and it is out of phase and unsynchronized). However, in this model, the articulating connecting rods can be done away with (but they can be used according to the need, for the designer this is just one more built-in feature).

The present standard diaphragm compressor (the present technology), exerts energy in the half—circle motor rotation for compressing the air, then in the next half-circle the motor rotation compresses the air; so then there is air suction to fill the chamber, therefore the energy consumption is much less (however, in the present-day technology, the same motor run this, the same power and the same consumption) for both half-circles, which is an efficiency loss (an analogy would be, for example: Using a "truck" to perform half the work, the same truck is used for the other half of the job that a simple motorcycle could do). Therefore in our technology, the object of our present patent, two or four diaphragms can be used, without increasing the energy consumption (better yet: just increasing the consumption a bit), even more with less total vibration for the component unit, greater performance, and a lot of other advantages gained.

Therefore, by using our technology, the object of this patent, two diaphragms can be utilized, without increasing the energy consumption this is the same as above. Therefore, applying our technology, the object of our present patent, it is possible to use two diaphragms, without increasing the energy consumption (in other words without increasing in any meaningful way), including less vibration in the whole component unit, greater performance, among many other advantages to be gained.

On diagram sheet 4/9, FIG. 19, there is displayed a more detailed derivative technology model, where just the double crankshaft and the connecting rods (articulating) are done away with and therefore a safety ring is added (this is a soft material such as rubber, nylon, ambatex, or any other similar material), shown as number 127, the purpose is to reduce any collision impact between the two pistons. Two equal polarity magnetic extremities may be placed at both ends (repellant, known as "permanent magnet" or "electro magnets") on the piston tips (this is also for reducing the impact). Or there may be a spring placed between the two pistons (for avoiding collision impact and favor harmonic oscillatory movement. Numbers 128 and 129 display electromagnetic coils (there may also be only one coil, for each piston, the designer may choose this option), which are activated from the magnetic core 130, piston 131, moving linearly (back and forth). Numbers 132 and 133 display the fluid compressor chambers. Numbers 134 and 135 are non-magnetic rings (and preferably, they are electrical non-conductors), for spacing between the coils.

Another detail on diagram sheet 4/9, FIG. 19, number 136 displays a ring fitting for attaching coils 128 and 129. Number 137 displays a protuberance on the cylinder wall. The main purposes are: mechanical support for the coils; and reinforcing the cylinder wall against internal mechanical pressure produced by the pressurized fluid.

Number 138 shows the hole for the fluid entrance and exit.

Number 139 shows a compartment for housing an electronic component set for controlling the coils, as well as, controlling the position sensors (that show the position of each piston), while the equipment is operating (going back and forth) these may be an inductive sensor, capacitive sensor, or others, etc.

This model runs the same as those that are based on the double crankshaft and connecting rods.

Although, there is a need for a dependable electronic controller (this needs to be well-adjusted), and that slides almost frictionless, keeping the oscillating movement, perfectly symmetric, and unsynchronized (out of phase) to eliminate all vibration.

Figure 24:
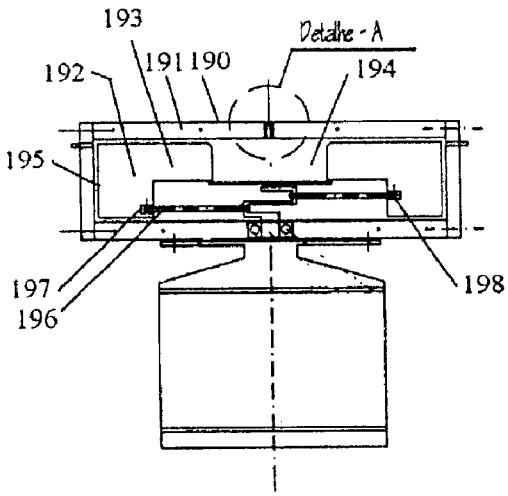
FIG. 24 is a cross-sectional elevational view of a compressor unit.
Figure 25:
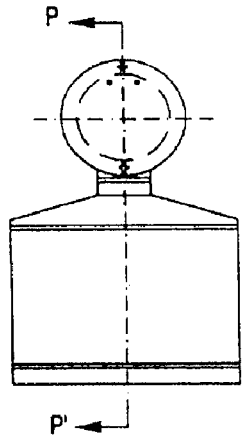
FIG. 25 is an elevational front view of a compressor unit.

On page 6/9, FIG. 24, an optional construction design is displayed, without any "articulating connection rod." However, there are two "different diameters of pistons." Number 190 displays the external cylinder (which is also the external housing). Number 191 displays the two-halves of the values fitting (as if there were "two shells" that close uniformly). Look at the left piston: number 192 displays the larger diameter and number 193 the smaller piston. Number 194 displays the central compressor chamber.

It is possible for computer cooling use, such as "REFRIGERATED MICRO-PROCESSOR" (especially in the model presented on Page 4/9). It is not necessary to "refrigerate," but just "does not let it overheat" beyond a certain limit, this if for "doing away with condensed water," keeping it dry and safe. In the same way, using our technology there are many novel uses, or improvements can be performed on various technological fields; including lightweight, low volume, low energy consumption, also it does not harm the environment and includes a low cost, etc .

Applying our invention (double piston, double crankshaft, articulating connecting rods, etc . ) and it is operates on a solenoid coil, therefore eliminating any unwanted vibration (or it can unnoticed, this is; for example shown on diagram 4/9, FIG. 15 and FIG. 18. However, an electric motor may be used, with "little vibration," reduced but still there is unwanted vibration, on account of the intermittent motor torque. Still, "the old-fashioned vibration" caused by the intermittent vibration of the piston (present in the present-day technology) is done away with (out of phase).

On page 6/9, an optional construction design is displayed, without any "articulating connection rod."

However, there are two "different diameters of pistons." Number 190 displays the external piston (which is also the external housing). Number 191 displays the two-halves fitting (as if there were "two shells" that close uniformly). Look at the left piston: 192 displays the larger diameter and 193 the smaller. Numbers 194 and 195 (being that 195 is symmetric to the compression chamber from the opposite side) display compression chambers (or combustion if applied in this specific unit, the object for our present patent, for combustion engines). Number 196 displays the "single connecting rod" (that is "non-articulating," which is also symmetric), 197 displays the cavity for housing the "single connecting rod" and 198 displays a pin (axle, ball bearing, or screw) that attaches the connecting rod in its proper placement.

View 25 displays an external view from the outside of the closed unit (after assembling).

Figure 26:
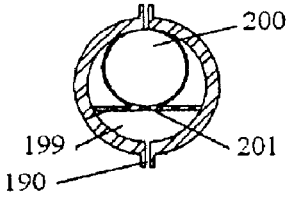
FIG. 26 is a cross-sectional view of a cylinder.

Still referring to page 6/9, FIG. 26, displays a cutaway view of cylinder 190 (see FIG. 24), whereas 199 and 200 display the larger and smaller diameters, respectively. Number 201 displays the outer walls (similar to two shells that close together forming a "sealed covering," or housing).

Figure 27:
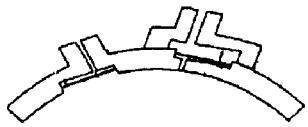
FIG. 27 is a view of unidirectional valves.

FIG. 27 displays the construction method for the unidirectional valves.

Figure 28:
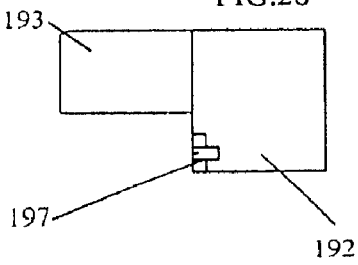
FIG. 28 is a lateral view of a two diameter piston.
Figure 29:
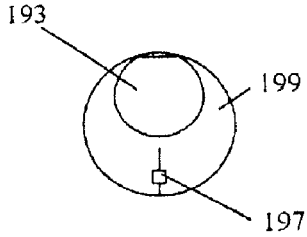
FIG. 29 is a front view of the piston of FIG. 28.

FIG. 28 displays a lateral view for the two-diameter piston, separated (this separation of the unit is for improved visualization). FIG. 29 shows the same piston, now from the front view. Whereas 199 is the larger diameter and 193 is the smaller diameter. 197 is the connecting rod fitting.

On page 7/9, another optional construction method is shown whereas there is just one external cylinder (see 210, FIG. 30) and only one internal piston (see 20 on the same FIG. 30) thereby profiting from some of our technology properties; the object of our present patent, that relates to: the fluid compression at both extremities of the piston.

Figure 30:
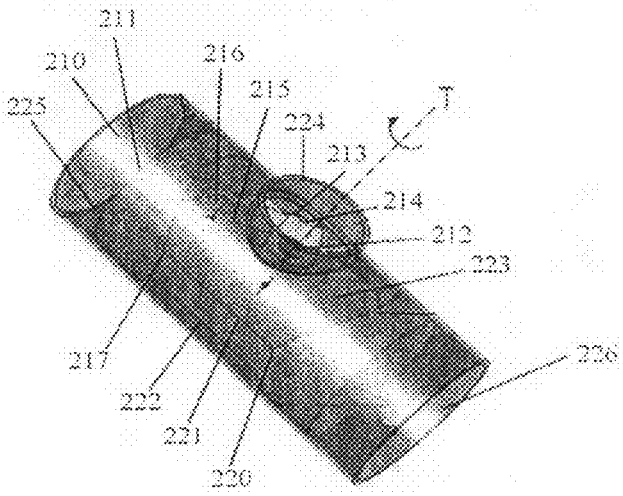
FIG. 30 is a perspective view of a compressor unit of the invention.

Even yet on sheet 7/9, FIG. 30, there is a perspective view of the unit, the motor has been removed from the drawing for improved visibility of the unit (since the motor is not the main aspect of our present patent), although, the motor axle is fitted in at hole 212 on the drawing.

The axle rotation 212, consequentially transmits rotational movement to rod; this rod is fitted by the pin or rotational axle 214, to the other rod shown by 215, like this, this rod 215 functions as a connecting rod, whereas it is held in place by the pin or rotational axle 216, to the piston 211, making this last movement in a back and forth direction inside the cylinder 210. Numbers 217 and 220, displayed in the symmetric slot on the piston, leaving a physical space for fitting in the mechanisms (this is: rod, connecting rod, pins, etc . ). Number 221 shows the symmetric slot on the opposite side, in this manner 222 shows an empty space (that can optionally hold lubrication oil), similar to the space shown by 223. Number 224 displays a flange (or a hole in the housing), for fitting in the motor. Numbers 225 and 226 display the compression chambers.

Figure 31:
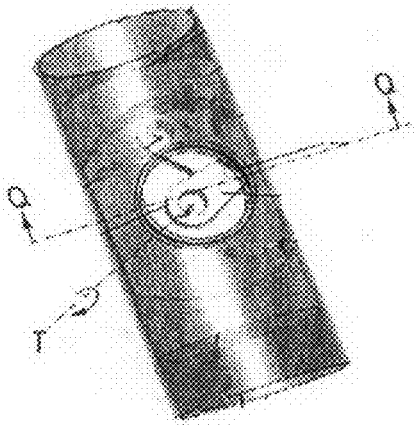
FIG. 31 is a top view of the unit of FIG. 30.
Figure 32:
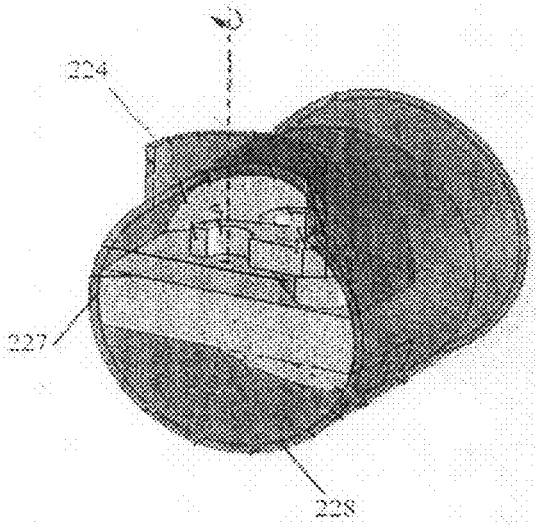
FIG. 32 is a cutaway view of the unit of FIG. 30.

Another detail on sheet 7/9, FIG. 31, displays "TOP VIEW" for the unit.

Cutaway 32 displays a cutaway view of the unit (see cutaway line displayed on the diagram FIG. 31. Number 50 is a flange for fitting in the motor. Number 227 displays the space (intersection) between the external cylinder 228 and the piston. This piston can be built from various materials such as: Teflon, nylon, aluminum, steel, etc .

Figure 33:
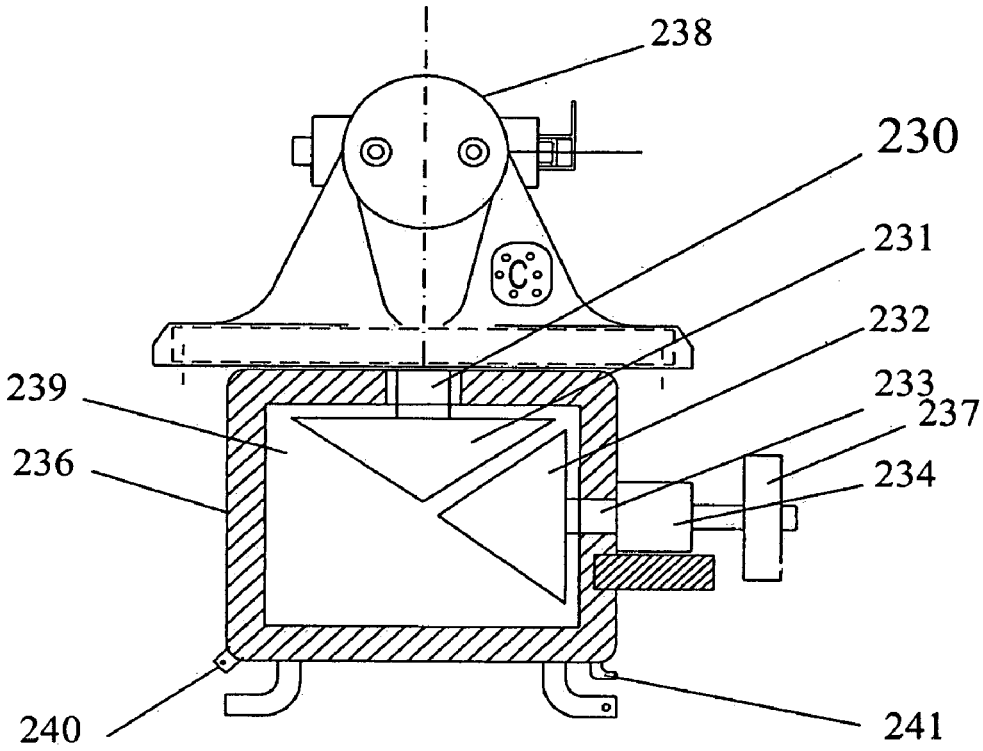
FIG. 33 is an elevational view of an embodiment of a compressor unit adapted for automotive use.
Figure 34:
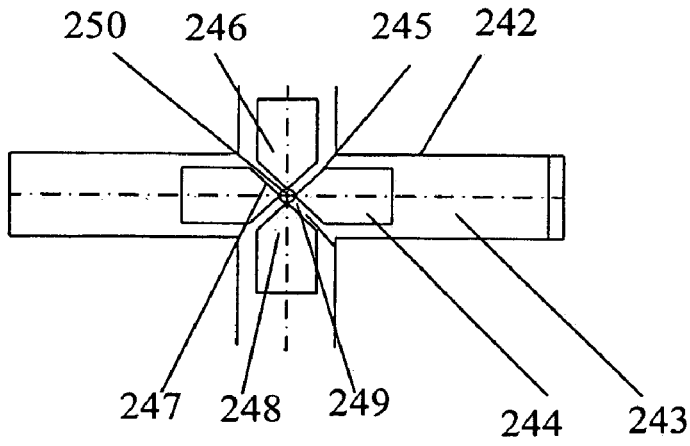
FIG. 34 is a further view of the compressor of FIG. 33.

On diagram sheet 8/9 FIGS. 33 and 34 is displayed a derivative model of this invention, the object of this present patent, this particular use is for the automotive field (air-conditioning), to be more specific: Applied to the external axle, for example the combustion engine, etc . utilizing a drive belt, gears, gear housing, etc .

Another detail on page 8/9, FIG. 33, this displays the compressor equipment set (the same as the above mentioned), 230 is the double crankshaft axle, which now, in this specific model, goes through the gear housing (it is possible to use, the oil retaining seal, or rubber gasket) and through the conical gear transmission (see 231 and 232), rotational movement is dislocated to axle 233, that by the oil retaining gaskets 234, going through housing 236 dislocating rotation to the pulley, in this case the movement is the direction of the transmission rotation, this goes the opposite direction of pulley 237 to axle 230, so that the rotational transmission propels compressor equipment set 238.

The housing (gear housing) 239 is optionally bathed in lubricating oil, then there may be a gasket on the roller bearings where the axles come out 230 and 233.

Numbers 240 and 241 display the support base, or the attachments for the automobile, truck, or any other vehicle or stationary motor housing.

Another detail on sheet 8/9, is FIG. 34 that shows a more appropriate model for automobiles, where the compressor equipment set has two orthogonal compressor cylinders (which is an external housing casing, a cross shape, or in other words: perpendicular to each other), forming as such a double fluid compressor chamber, making it possible for faster drainage, increasing the refrigeration capacity. Number 242 shows the "orthogonal equipment set," 243 shows one of the compressor chambers, 244 is the piston (there is a total of four pistons, but it is possible to build up to eight or more pistons. Like this, doubling the compression chambers). Numbers 245, 246, 247, and 248 are the piston ends at a 45 degree angle, forming in such a way a "five compression chamber" every time the four pistons meet at this position, the quadruple chamber is shown as 249. Number 250 displays a hole (or canal) for the fluid inflow and outflow, naturally going through the unidirectional valves (that has already been explained in this report).

In automotive vehicles (air-conditioning), our technology can be applied extremely well, including many innovative applications. For example, there is less energy consumption; it cools much faster; and etc . ). This is the object of our present patent, without a propelled axle, then it is propelled by electricity, straight from the solenoid coils, promoting as such, intermittent advance and retraction of the pistons.

On diagram page 9/9, there is displayed a cutaway view of the compressor (according to the previous reference (see report, sheet 1/10, line x). There are great features included in this simplified model that are:

a) There is no motor for traction (but just a solenoid coil); and b) There are "dual" (tandem) compressor chambers, one on each extremity of the piston.

Figure 35:
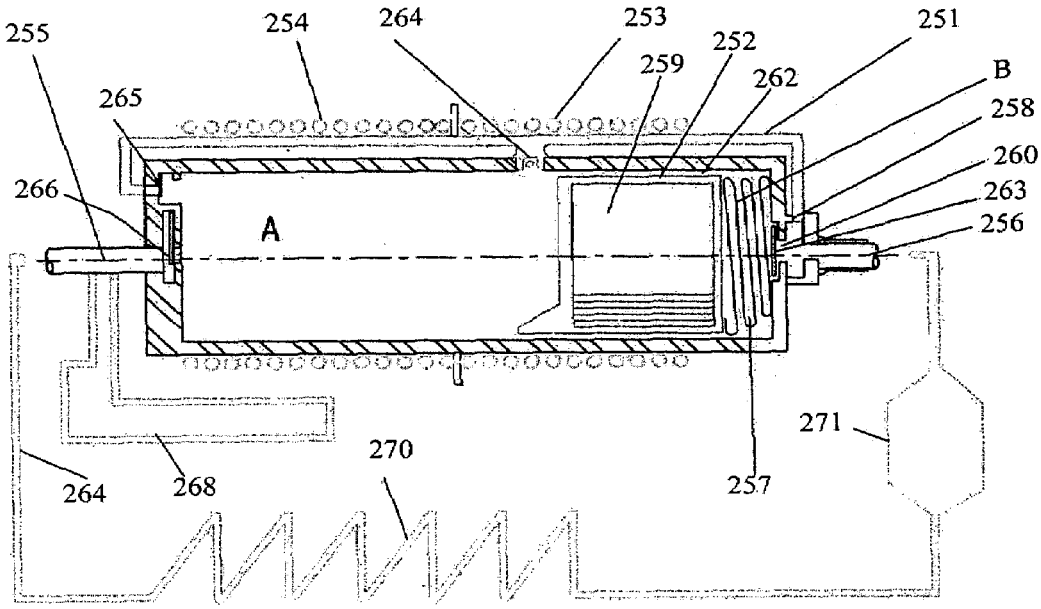
FIG. 35 is a cross sectional view of a cylinder.

Page 9/9 on FIG. 35, # 251 displays a hollow cylinder that houses piston # 252, # 259 displays a ferromagnetic core, the coils 253 and 254, driven in an intermittent manner driving the piston (back and forth).

The piston is in the retracted position (according to the diagram shown FIG. 35 sheet 9/9), the compression chamber "A" is full of fluid, causing the coils to move compressing the fluid and expelling it through hole # 255. Now that the piston has been driven forward in which case compression chamber "B", is driven again by the coils driving the piston that compresses the fluid and expels it through hole 256. Number 262 displays the piston surface lining that does not suffer any wear (for example: Teflon, or any similar). No. 257 is an optional spring (for piston retraction, in case one wishes to only use "one" solenoid coil (for forward movement). Numbers 253, 254 and 258 are the fluid inlets, numbers 263, 264, 265 and 266 are unidirectional valves, number 268 is a pressurized fluid "deposit" (to improve continued drainage).

Numbers 269, 270 and 271 symbolically display a closed circuit (similar to that which takes place in a refrigerator, with a vaporizer, condenser, etc . ).

Figure 36:
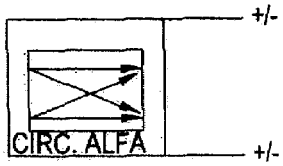
FIG. 36 is a schematic view of a closed circuit for driving a pump.
Figure 37:
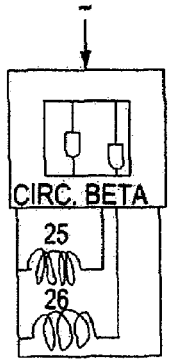
FIG. 37 is a schematic view of a closed circuit for driving a pump.
Figure 38:
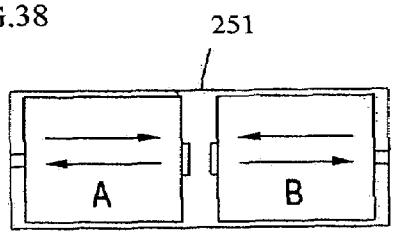
FIG. 38 is a cross-sectional view of a cylinder.

Other details on sheet 9/9 are FIG. 36 and FIG. 37 that display a simplified design of the electrical signal that drives the pumps (to cause intermittent driving of the solenoid coils, thereafter causing the back and forth piston movement).

FIG. 23 displays a simplified explanation on how the two compression chambers are formed while only using a "single" external cylinder and just one piston.

The invention claimed is:

1. A dynamic system for refrigeration equipment comprising:

a hollow cylinder;

a pair of pistons located longitudinally inside said hollow cylinder;

a pair of non-segmented, connection rods, each said connection rod being connected to each said piston; and a double crankshaft connected to said connection rods, said double crankshaft rotating on an axle;

wherein as said double crankshaft rotates on said axle, said pistons are displaced linearly and symmetrically, said pistons moving forward and then retracting based on a rotational frequency of said double crankshaft, said displacement defining three compression chambers for a fluid within said hollow cylinder, one compression chamber at each end of said hollow cylinder and one compression chamber in the center of said hollow cylinder, said center compression chamber usually being double the volume of each said end chamber.

2. A dynamic system for refrigeration equipment comprising:

a hollow cylinder;

a pair of pistons disposed longitudinally within said hollow cylinder;

two shafts, each of said pistons being connected to a respective said shaft; and a double crankshaft, said shafts being connected to said double crankshaft for rotating said crankshaft;

wherein, as said pistons are displaced linearly, moving forward and then retracting according to a rotational frequency of said double crankshaft, three compression chambers for a fluid are defined within said hollow cylinder, one compression chamber on each side of said hollow cylinder and one compression chamber in the center of said hollow cylinder;

wherein, an axle rotational movement is propelled by an electric or other kind of motor, and an oil seal is provided to prevent oil from entering said motor.

3. A dynamic refrigeration system comprising:

a hollow cylinder;

a pair of pistons disposed longitudinally within said hollow cylinder;

two articulating connecting rods, each of said pistons being connected symmetrically to a respective said articulating connecting rod;

a double crankshaft, said articulating connecting rods being connected to said double crankshaft for rotating said double crankshaft;

wherein, said double crankshaft moves the pistons linearly, said pistons moving forward and then retracting according to a rotational frequency of said double crankshaft, said pistons and said hollow cylinder forming three compression chambers for a fluid, one compression chamber on each side of said hollow cylinder and one compression chamber in the center of said hollow cylinder, a rotational movement of said pistons being propelled by an electric solenoid coil, attached to the outside of said hollow cylinder, a ferromagnetic core inside each said piston being adapted as an internal spring that pulls the piston back, and two or more solenoid electrically activated coils move the piston forward or backwards in intervals, this movement constantly propelling said double crankshaft, annulling vibration by means of an out of phase vibration and therefore eliminating the vibration.

4. A dynamic refrigeration system comprising:

one, two or multiple hollow cylinders, attached perpendicularly (crossed), or at an angle;

a pair of pistons disposed inside each said hollow cylinder for movement longitudinally within said hollow cylinder;

a crankshaft, said pistons being connected to said crankshaft; and a double crankshaft, said crankshaft being connected to said double crankshaft, said double crankshaft moving said pistons linearly, each said piston moving forward and then backwards according to a rotational speed of said double crankshaft, each hollow cylinder defining three compression chambers for a fluid, one compression chamber at each end of said hollow cylinder and one compression chamber in the center of said hollow cylinder, said fluid being one of the group of fluids consisting of: R-134, Freon 12, Freon 22, or another type of refrigerant gas;

wherein, gas circulation, compression, and expansion are controlled by unidirectional valves made of a thin steel sheet and a cylindrical spacer pad that is fit into a groove on the inside of each said hollow cylinder, flush to each said compression chamber, said unidirectional valves being protected by a housing, wherein said housing is formed by two shells that form a capsule when closed, which surround and protect said unidirectional valve including a stator, rotor, electric motor axle, said capsule being closed by welding or screws.

5. A dynamic system for refrigeration equipment comprising:

a hollow cylinder;

a pair of pistons located longitudinally inside said hollow cylinder;

two articulating connected rods, one of said connected rods being connected to each of said pistons; and a double crankshaft, said articulating connected rods being connected to said double crankshaft;

wherein, as said double crankshaft rotates on an axle thereof, said pistons are displaced linearly and symmetrically, said pistons moving forward and then retracting based on a rotational frequency of said double crankshaft, said displacement defining three compression chambers for a fluid within said hollow cylinder, one compression chamber at each end of said hollow cylinder and one compression chamber in the center of said hollow cylinder, said center compression chamber usually being double the volume of each said end chamber further comprising a fluid compressor attached to a tank of compressed air.

6. The dynamic refrigeration system of claim 5, said compressor is powered by means of a pulley belt, gears, or Cardan axle.

7. A dynamic refrigeration system comprising:

a hollow cylinder;

a pair of pistons disposed longitudinally within said hollow cylinder;

two nonsegmented, connection rods, each of said pistons being connected symmetrically to a respective said connection rod;

a double crankshaft, said articulating connection rods being connected to said double crankshaft for turning said double crankshaft, and moving said pistons linearly, one of said pistons moving forward and then backwards according to a frequency of said double-crankshaft, said pistons and said hollow cylinder forming three compression chambers for fluid, one compression chamber at each end of said hollow cylinder and one compression chamber in the center of said hollow cylinder;

wherein, said three compression chambers function as combustion chambers, which can be used as a combustion motor setup to get constant rotation, and consuming similar fuel as an automobile or truck combustion engine.

8. A dynamic refrigeration system comprising:

a double crankshaft:

two connecting rods, connected to said double crankshaft;

two diaphragms:

each said connecting rod being connected to a respective diaphragm, wherein a rotation of said double-crankshaft produces a contraction and an expansion movement of said diaphragms, said diaphragms functioning to suction air and compress said air, said system further comprising bi-directional valves for directioning said compressed air to a piping connection.

9. The dynamic refrigeration system of claim 8, wherein each said connecting rod is connected to a specific diaphragm, wherein a rotation of said double crankshaft produces a symmetric contraction and expansion of said diaphragm.

10. A dynamic system for refrigeration equipment comprising:

a hollow cylinder;

a pair of pistons located longitudinally inside said hollow cylinder, each of said pistons being configured for motion in a direction opposite from that of the other piston, said pistons defining three compression chambers for a fluid within said hollow cylinder, one compression chamber on each side of said hollow cylinder and one compression chamber in the center of said hollow cylinder;

said dynamic system further comprising four solenoids, wherein the two pistons move back and forth in said cylinder, being activated by said four solenoids, two solenoid coils being associated with each piston, and wherein, said four solenoids are activated by electronic generator pulsators.

11. A dynamic system for refrigeration equipment comprising:

a hollow cylinder;

a pair of pistons located longitudinally inside said hollow cylinder;

two articulating connected rods, each said connected rod being connected to a respective said piston; and a double crankshaft, said articulating connected rods being connected to said double crankshaft;

wherein, as said double crankshaft rotates on an axle thereof, said pistons are displaced linearly and symmetrically, said pistons moving forward and then retracting based on a rotational frequency of said double crankshaft, said displacement defining three compression chambers for a fluid within said hollow cylinder, one compression chamber at each end of said hollow cylinder and one compression chamber in the center of said hollow cylinder, said center compression chamber usually being double the volume of each said end chamber;

further comprising unidirectional valves having a fluid flow hole which is blocked by a thin sheet, made out of a thin "curved" plastic or metallic sheet, and having a valve base which is curved (concave or convex).

12. A dynamic refrigeration system for refrigeration equipment comprising:

a hollow cylinder;

a pair of pistons located longitudinally inside said hollow cylinder;

a pair of articulating connecting rods, each articulating connecting rod being connected to a respective said piston; and a double crankshaft, said articulating connecting rods being connected to said double crankshaft;

wherein as said double crankshaft rotates on an axle thereof, said pistons are displaced linearly and symmetrically, said pistons moving forward and then retracting based on a rotational frequency of said double crankshaft, said displacement defining three compression chambers for a fluid within said hollow cylinder, one compression chamber at each end of said hollow cylinder and one compression chamber in the center of said hollow cylinder, said center compression chamber usually being double the volume of each said end chamber; and wherein said pistons are fabricated of two symmetric halves that fit inside said cylinder and wherein ferromagnetic material cores are positioned within said pistons.

13. The dynamic refrigeration system of claim 12, further comprising solenoid coils placed on the outside of said hollow cylinder, wherein the pistons are moved by means of a magnetic action.

14. The dynamic refrigeration system of claim 13, wherein said two solenoid coils are interconnected by a helicoidal spring.

15. A dynamic system for refrigeration equipment comprising:

a hollow cylinder;

a pair of pistons located longitudinally inside said hollow cylinder;

two articulating connected rods, each said connected rod being connected to a respective said piston; and a double crankshaft, said articulating connected rods being connected to said double crankshaft;

wherein, as said double crankshaft rotates on an axle thereof, said pistons are displaced linearly and symmetrically, said pistons moving forward and then retracting based on a rotational frequency of said double crankshaft, said displacement defining three compression chambers for a fluid within said hollow cylinder, one compression chamber at each end of said hollow cylinder and one compression chamber in the center of said hollow cylinder, said center compression chamber usually being double the volume of each said end chamber;

further comprising at least one additional overlaid hollow cylinder assembled with said hollow cylinder in a cross shape.

16. The dynamic refrigeration system of claim 15, further comprising two additional hollow cylinders, each said additional cylinder being fitted with a pair of pistons, said hollow cylinders being arranged perpendicular to one another, all of said pistons of said cylinders being connected to said double crankshaft.

* * * * *